United States Patent [19]

Ortelli

[11] Patent Number: 4,548,124

[45] Date of Patent: Oct. 22, 1985

[54] RADIAL PISTON HYDRAULIC MOTOR WITH VARIABLE ECCENTRICITY

[75] Inventor: Aurelio Ortelli, Bologna, Italy

[73] Assignee: Riva Calzoni S.p.A., Bologna, Italy

[21] Appl. No.: 581,624

[22] Filed: Feb. 21, 1984

[51] Int. Cl.[4] ..... F01B 3/00; F04B 1/26

[52] U.S. Cl. ..... 92/12.1; 91/497; 417/221

[58] Field of Search ..... 91/497; 417/221; 74/571 R, 571 L; 92/12.1

[56] References Cited

U.S. PATENT DOCUMENTS

| | | | |
|---|---|---|---|
| 1,274,955 | 8/1918 | Sundh | 74/571 L |
| 2,404,175 | 7/1946 | Holden et al. | 74/571 |
| 3,828,400 | 8/1974 | Mason | 91/497 |
| 3,908,517 | 9/1975 | Wenbourne | 91/497 |
| 4,195,553 | 4/1980 | Klie | 417/271 |
| 4,320,692 | 3/1982 | Komiya | 91/497 |

FOREIGN PATENT DOCUMENTS

| | | | |
|---|---|---|---|
| 534675 | 3/1941 | United Kingdom | 74/571 |

*Primary Examiner*—William L. Freeh

*Attorney, Agent, or Firm*—Guido Modiano; Albert Josif

[57] ABSTRACT

The invention relates to a hydraulic motor of the type comprising a plurality of cylinder-piston units arranged radially about an eccentric cam made rotatively rigid with a rotating shaft. The cam has a pair of shoes which project axially from opposite sides thereof and engage in guides formed diametrically in a pivotable support and on a rotating shaft, respectively. The shoes engage with such guides to allow for a radial displacement of the cam and provide a rotary connection of the latter to the rotating shaft. The shoes have respective cylindrical cavities formed internally in perpendicular directions to the shaft axis of rotation, cavities which accommodate small pistons whose rods are stationary relatively to the rotating shaft. The small pistons define, on the inside of the respective cavities, two chambers which may be connected to a pressurized fluid supply to control the displacement of the cam in a radial direction to the rotating shaft, thereby changing the swept volumes of the cylinder-piston units.

4 Claims, 2 Drawing Figures

RADIAL PISTON HYDRAULIC MOTOR WITH VARIABLE ECCENTRICITY

BACKGROUND OF THE INVENTION

This invention relates to a radial piston hydraulic motor with variable eccentricity.

Hydraulic motors having a number of cylinder-piston units arranged radially about a cam or eccentric which is attached to the motor rotating shaft are known in the art.

Propulsive power is transmitted to the cam by means of a working fluid being pressurized by a specially provided pump and cyclically distributed to the various cylinder-piston units by a distributor.

In order to change the motor power output, the pump operation is controlled to variously set the working fluid flow rate and pressure. However, this requires the availability of a pump which can be adapted to different operating conditions of the motor, and accordingly, a large size one.

It has also been proposed to vary the motor eccentricity so as to change its swept volume and, hence, the torque transmitted to the rotating shaft and the rotational speed, while keeping the pump delivery rate constant.

SUMMARY OF THE INVENTION

Thus, it is a primary object of this invention to provide a variable displacement radial piston hydraulic motor of simple design, reliable operation, and limited weight and bulk.

That object is achieved by a hydraulic motor of the type comprising a plurality of cylinder-piston units arranged radially about an eccentric cam coupled for rotation with a rotating shaft, characterized in that said eccentric and said shaft have cooperating guide means allowing relative movement between said shaft and said eccentric in a direction transverse to the axis of rotation of said shaft and maintaining said eccentric and said shaft in common rotatory relationship, said guide means having cooperating cylinder-piston formations defining opposite cylinder-chambers and duct means for selectively supplying or exhausting pressure fluid in said cylinder chambers to thereby shift along said guide means said eccentric transverse with respect to said shaft in a selected relative position thereof.

BRIEF DESCRIPTION OF THE DRAWINGS

The invention features will be more clearly understood from the following detailed description of a preferred embodiment thereof, as illustrated by way of example in the accompanying drawing, where.

DESCRIPTION OF THE PREFERRED EMBODIMENT

Figure 1:
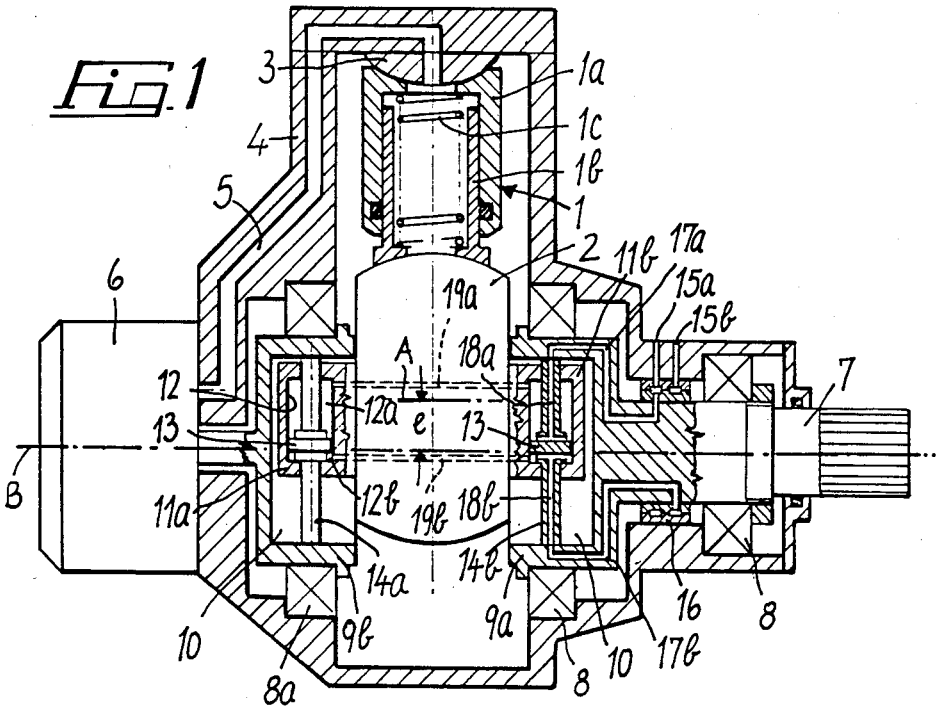
FIG. 1 is a longitudinal section view of a hydraulic motor according to this invention.
Figure 2:
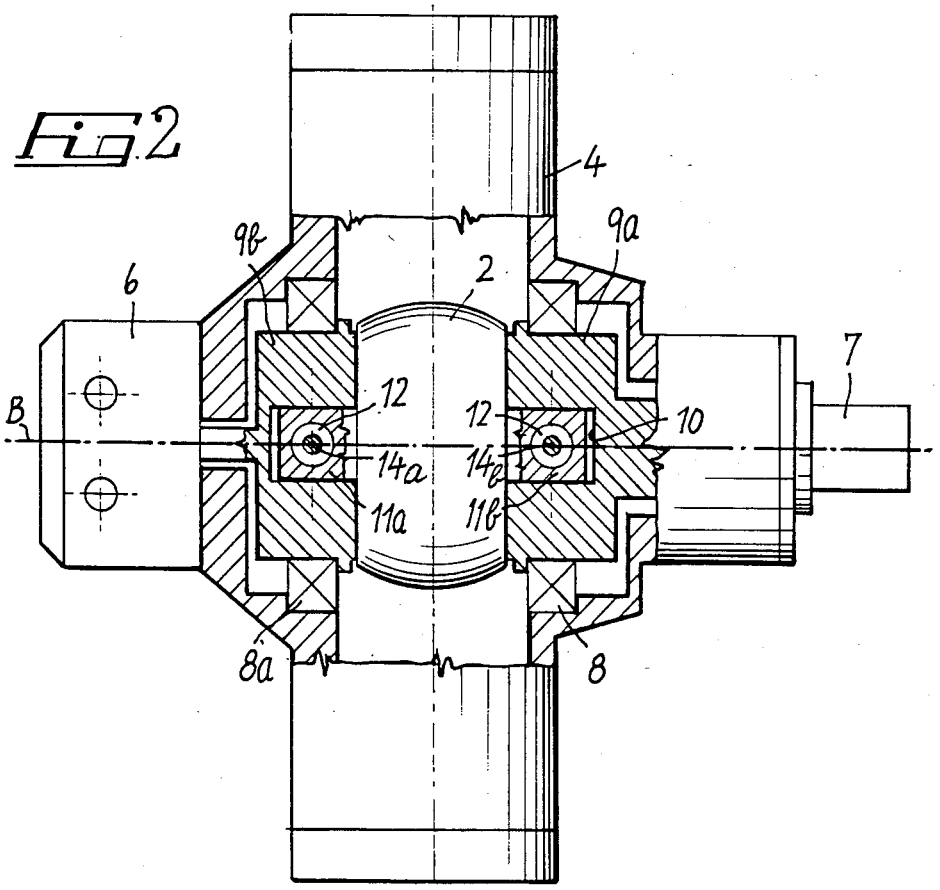
FIG. 2 is a partly sectional view of that same motor as taken in a longitudinal plane perpendicular to that of FIG. 1.

The motor shown in the drawing comprises a plurality of oscillating cylinder-piston units 1 which are arranged to bear with one end on an eccentric cam 2 having a spherical surface and with the other end, on respective spherical caps 3 rigid with the motor case 4.

The cylinder-piston units 1, which will be called hereinafter simply "pistons" are arranged radially about the cam 2 and each include, in a manner known per se, a pair of cylinders 1*a*, 1*b*, which are guided sealingly one within the other and biased against the cam and cap by a spring 1*c*.

The pistons are in communication with a respective working fluid delivery conduit 5 which is formed in the case 4 and extends through the cap 3.

The working fluid, which is pressurized by a specially provided pump, flows through the pistons 1 and acts on the cam 2. A conventional distributor member 6 distributes the working fluid cyclically to the various pistons.

The eccentric cam 2 is coupled for rotation with a rotating shaft 7 which is supported inside the case 4 on rolling bearings 8. For connection to the cam 2, the shaft 7 is provided with a drum-like formation 9*a*, a similar drum-like formation 9*b* being coupled for rotation on the opposite side of the cam 2 and is carried in a bearing 8*a*.

Formed inside each drum formation 9*a*, 9*b*, is a guiding seat of prismatic shape 10 having its longitudinal axis extending parallel to a diameter of the cam 2 and in which is slidably engaged and guided a related projection or shoe 11*a*, 11*b*. The shoes are formed frontally on opposite sides of the cam 2 and in the shown embodiment are advantageously offset at least in one direction with respect to the symmetry axis A of the cam. Thus, the cam can slide transversely to the rotating shaft 7, thereby its eccentricity can be changed from a zero value, whereat its axis A would coincide with the axis B of the shaft 7, up to a value "e" of maximum eccentricity. A cylindrical cavity 12 is formed inside the shoes 11*a*, 11*b* which in the embodiment shown has its axis perpendicular to that of the cam 2 and parallel to the longitudinal axis of the seat 10. Guided within each cavity 12 is a small piston 13 which divides said cavity in two chambers, 12*a* and 12*b*.

Each small piston is attached at a middle position to a respective rod 14*a*, 14*b* which extends longitudinally through a respective cylindrical cavity 12 and extends sealingly out of the shoes 11*a* and 11*b*. The rods 14*a*, 14*b* rest with their opposite ends against the confronting walls of the drum-like formations 9*a*, 9*b* and are arranged stationary therein.

The two chambers 12*a*, 12*b* of the cavities 12 are connected to a pressurized fluid supply. To this aim, on the case 4 there are provided a pair of holes 15*a*, 15*b* in communication with a rotary coupling 16, of conventional design, which surrounds the rotating shaft 7. That coupling 16 also communicates the holes 15*a*, 15*b* to respective conduits 17*a*, 17*b* extending inside the shaft 7 and drum formation 9*b* at diametrically opposite positions, so as to open respectively into bores 18*a*, 18*b* formed axially through the rod 14*b*.

The bores 18*a*, 18*b* each open, in the proximities of the small piston 13, into one of the chambers 12*a*, 12*b* respectively, defined in the cavity 12 of the shoe 11*b*. Such chambers, in turn, are in permanent communication with the corresponding two chambers 12*a*, 12*b* of the cavity 12 of the shoe 11*a* via channels 19*a*, 19*b* formed through the cam 2. Thus, the delivery of pressurized fluid through one of the two holes 15*a* or 15*b* into one of the conduits 17*a* or 17*b* enables two corresponding chambers 12*a* or 12*b* of both cavities 12 to be pressurized. The other two chambers 12*b* or 12*a* are, of course, selectively connected to the fluid exhaust. The alternative connection of the holes 15*a*, 15*b* with the pressure fluid or exhaust respectively occurs by valve and circuit means of conventional design, not shown, such as a slide valve or the like.

Since the small pistons 13 are stationary relatively to their respective drum formations 9*a* or 9*b*, respectively the pressurized fluid will move the shoes 11*a*, 11*b* within the seats 10 of the drum formations 9*a*, 9*b*. Accordingly, the cam 2 will move radially with respect to the axis of the rotating shaft 7, thus changing by a desired amount the eccentricity and hence the motor operating characteristics. It should be noted that the cam 2, being required to accommodate no devices on its interior, is a massive one and accordingly highly indeformable under the powerful hydraulic stresses, thus ensuring optimum volumetric efficiency. Further, it may have greatly reduced radial dimensions, thus affording enormous advantage from the standpoint of the motor overall radial space requirements. With this solution, therefore, it becomes possible to adopt the same cam diameter as used in fixed displacement motors, which results in the utilization of the same pistons and in related economic advantages.

It should be further noted that the cam 2 is effectively guided between the drums formations 9*a*, 9*b* in its radial movement with respect to the rotating shaft 7, thereby the motor reliability can be guaranteed.

In practicing the invention, the shapes and dimensions may be any ones meeting individual application requirements.

I claim:

1. A hydraulic motor of the type comprising a case, a plurality of cylinder-piston units lodged in said case and radially arranged about an eccentric, said eccentric being coupled for rotation with a rotating shaft, the motor further comprising drum-like formations rotatably supported on both sides of said eccentric and coaxially with said shaft, one of said formations being rigidly connected to said shaft, a guiding seat of prismatic shape formed diametrically in each of said drum formations, a pair of shoe members projecting from the opposite sides of said eccentric and engaging said guiding seats so as to permit radial displacement of said eccentric relative to said shaft in a direction transverse thereto and to maintain said eccentric and said shaft in common rotatory relationship, cylinder-piston devices being further provided arranged in said shoe members and acting on said drum-like formations to thereby displace said eccentric in said transverse direction.

2. A hydraulic motor according to claim 1 wherein said devices comprise a cylindrical cavity formed in each shoe member, a piston arranged in each cavity and having a rod extending longitudinally out of said cavity and having the opposite ends resting against the drum-like formations, said piston defining two chambers inside said cylindrical cavity, means being also provided for supplying a pressurized fluid into each of said chambers to control radial displacement of said eccentric.

3. A hydraulic motor according to claim 2 wherein said means comprises a pair of conduits formed within said rotating shaft and communicating with respective bores axially extending through said rod, each bore opening into a respective chamber, and said conduits being connected through a rotary coupling surrounding said rotating shaft and through respective holes in the case with a pressurized fluid supply.

4. A hydraulic motor according to claim 3 wherein the chambers of a cylindrical cavity formed in a shoe members are connected to the chambers in the other shoe member by channels extending through said eccentric.

* * * * *